United States Patent [19]

Deconinck

[11] 4,219,035

[45] Aug. 26, 1980

[54] CADDY OR HOLDER FOR DENTAL ACCESSORIES

[75] Inventor: Didier Deconinck, Isére, France

[73] Assignee: Allibert Exploitation, Grenoble, France

[21] Appl. No.: 930,161

[22] Filed: Aug. 2, 1978

[51] Int. Cl.[2] ..... A45D 44/18

[52] U.S. Cl. ..... 132/84 D; 211/65

[58] Field of Search ..... 132/84 D, 84 R, 79 F, 132/79 G, 79 R; 248/108, 109; 211/65, 66, 74

[56] References Cited

U.S. PATENT DOCUMENTS

| | | | |
|---|---|---|---|
| 2,038,941 | 4/1936 | Koch | 211/65 |
| 2,500,905 | 3/1950 | Raykoff | 211/65 |
| 2,611,380 | 9/1952 | Grower | 132/84 R |
| 3,893,569 | 7/1975 | Hoch | 211/74 |

FOREIGN PATENT DOCUMENTS

| | | | |
|---|---|---|---|
| 569589 | 2/1933 | Fed. Rep. of Germany | 132/84 D |

*Primary Examiner*—Jay N. Eskovitz

*Attorney, Agent, or Firm*—Karl F. Ross

[57] ABSTRACT

A device for holding a mouth-rinsing glass, toothbrushes and a tube of dentifrice comprises a molded synthetic resin body provided with two upwardly open mutually adjacent receptacles, one of which is dimensioned to receive a glass or cup while the other receives a tubular insert provided with at least two laterally extending ribs subdividing the second receptacle into a plurality of compartments each of which can receive the handle of a toothbrush. A tube of dentifrice can be inserted into the insert which is laterally open in the direction of the first receptacle to afford access to the finger of a user so as to enable him to remove the tube of dentifrice from the insert even when the tube has been shortened in use.

8 Claims, 3 Drawing Figures

CADDY OR HOLDER FOR DENTAL ACCESSORIES

FIELD OF THE INVENTION

The present invention relates to a dental accessory and, more particularly, to a holder for dental implements including a glass, a tube of dentifrice and one or more toothbrushes. Specifically the invention relates to a dental caddy adapted to be mounted upon a wash basin, hung from a wall or affixed to a bathroom fixture or other element to make available the aforementioned dental accessories in a particularly convenient manner.

BACKGROUND OF THE INVENTION

It is generally the practice to provide a bathroom or like toilet facility with a holder, which can be mounted upon the wall or provided upon a washbasin, upon which a mouth-rinsing glass can be placed. Alternatively and/or in addition, means may be mounted upon the wall or on the washbasin for receiving one or more toothbrushes.

All prior-art devices of this type have various inconveniences with respect to accessibility of the dental accessories, namely the glass or a cup, the tube of dentifrice and the toothbrushes, or are expensive, difficult to mount and difficult to clean. They pose problems with respect to the sanitary storage of the dental accessories as well.

OBJECTS OF THE INVENTION

It is the principal object of the present invention to provide an improved dental caddy for accessories adapted to store and render accessible a mouth-rinsing container or receptacle, a tube of dentifrice and one or more toothbrushes.

Still another object of the present invention is to provide an improved dental caddy which can be disposed at any selected location and which affords in a particularly sanitary and convenient manner accessibility to the various accessories used in the cleaning of teeth.

It is also an object of this invention to provide a glass holder and toothbrush holder for any bathroom or toilet facilities which will be free from the disadvantages of earlier devices for this purpose.

SUMMARY OF THE INVENTION

These objects and others which will become apparent hereinafter are attained, in accordance with the present invention, in a holder which comprises two upwardly open compartments or receptacles which are mutually parallel and serve respectively to receive a mouth-rinsing glass or receptacle and at least one toothbrush together with a tube of dental paste or dentifrice.

The holder body is thus formed with the two compartments adjacent to one another and communicating between them by an opening formed in the wall which separates the two compartments over substantially the entire height of these compartments.

According to the invention, the second compartment, i.e. the compartment which is to receive the tube of dentifrice and the toothbrushes, is provided with a cylindrical insert formed with at least two laterally extending longitudinal ribs defining within the second compartment a plurality of chambers surrounding a central chamber. The central chamber is dimensioned to receive the tube of dentifrice while the outer chambers are dimensioned to receive the handles of the toothbrushes. An opening over substantially the entire length of this insert communicates with the aforementioned opening in the wall separating the two compartments and thus enables the tube of dentifrice to be removed readily by the insertion of a finger of the user through the opening in the insert.

In a preferred mode of carrying out the invention in practice, i.e. the best mode currently known to me for carrying out the invention, the body is formed over the entire height of the two compartments with a pair of longitudinal diametrically opposite openings or windows which open into the first or glass-receiving compartment and which facilitate the withdrawal of the glass from the compartment by enabling the insertion of the fingers of the user.

One or the other of these last-mentioned openings thus also facilitates the manual access to the tube of the dental paste.

The removal of the tube of dentifrice may pose a problem when the latter has been shortened, with use, by rolling up the end of the tube. In this case, the tube may be fully received in the central chamber of the insert and there may be difficulty in withdrawing the tube from the upper end of the insert. By providing the various openings and windows in the manner described, it has been found that one can readily insert one's finger through the window and the coincident or registering openings to enable the tube of dentifrice to be readily removed.

The holder of the present invention can be made of any material affording sanitary cleaning, preferably a molded synthetic resin resistant to washing at elevated temperatures.

The body of the present invention is advantageously provided with a plurality of feet to enable it to be simply stood upon a convenient support, e.g. a shelf, a washbasin or the like. In addition, or alternatively, means may be provided for suspending the body from a wall, upon a bathroom cabinet, a sanitary fixture or some other element, usually present in a bathroom or toilet facility.

According to a feature of the invention, the wall separating the two compartments is provided with inwardly tapering ribs defining the first-mentioned opening between them. The insert, in this case, is advantageously formed with a pair of outwardly extending ribs which are received snugly between the inwardly extending ribs of the body to ensure effective positioning of the opening of the insert and of the wall in coincidence. In addition, the two lips of the insert may be provided at the bottom of the latter with a slender ligature affording structural stability.

While the first compartment, i.e. the glass-receiving compartment may be of generally circular cross section, the second compartment, the one receiving the cylindrical insert, is preferably rectangular in horizontal cross section.

BRIEF DESCRIPTION OF THE DRAWING

The above and other objects, features and advantages of the present invention will become more readily apparent from the description, reference being made to the accompanying drawing in which.

SPECIFIC DESCRIPTION

Figure 1:
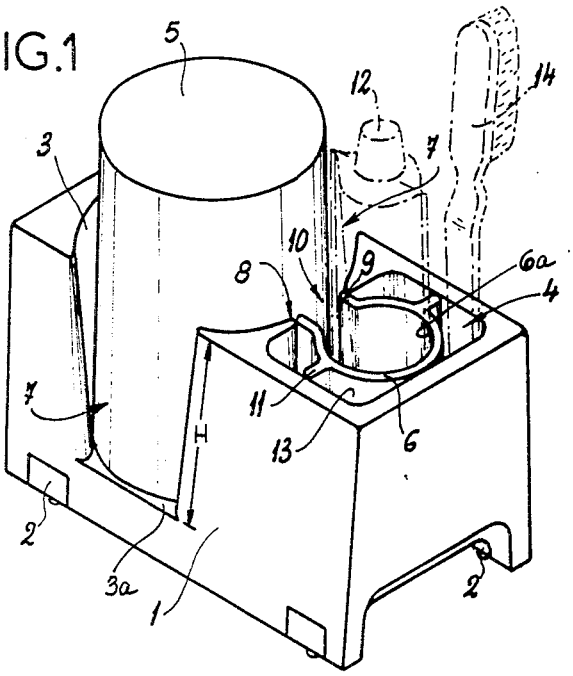
FIG. 1 is a perspective view of the carrier of the present invention showing the glass in place and a toothbrush and a tube of dentifrice in dot-dash lines.
Figure 2:
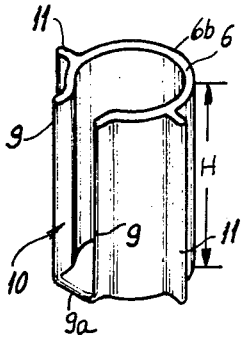
FIG. 2 is a perspective view of the insert body of the holder of FIG. 1.
Figure 3:
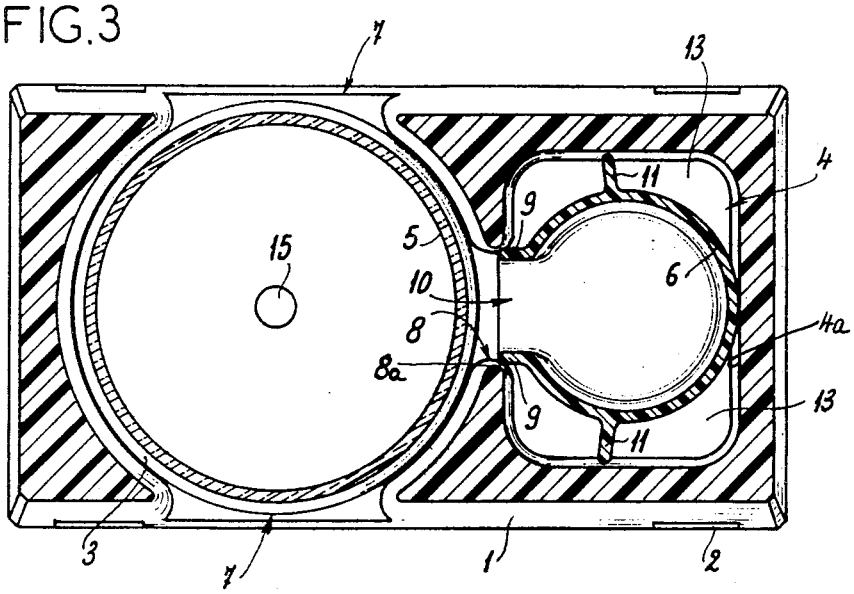
FIG. 3 is a cross-sectional view, taken in a horizontal plane, drawn to an enlarged scale of the device of FIG. 1.

In the drawing I have shown a body 1 of generally parallelepipedal configuration and preferably composed of synthetic resin material which has been molded, e.g. by injection molding or casting. The drawing thus illustrates the best mode known to me for carrying out the invention in practice. The body is provided with a plurality of feet 2 which enable it to be rested upon a horizontal surface. The four feet thus can allow the body to be stood upon a lavatory, upon a table above a lavatory, a shelf or the like. Alternatively, a wall of the body may be provided with openings from which the body can be suspended from hooks previously affixed to the wall.

The body 1 is provided with two upwardly open seats of compartments 3 and 4 which are mutually parallel and have mutually parallel axes, these compartments being open at the upper face of the body.

The generally circular-section compartment 3, which is larger than the other compartment, is dimensioned to receive a glass 5 shown to be inverted and resting upon the floor 3*a* of the first compartment. The glass 5 is the mouth-rinsing glass commonly provided in the washroom, bathroom or toilet.

The second compartment 4, which is intended to accommodate the tube of dentifrice 12 and one or more toothbrushes 14, is of smaller cross-sectional area and, as shown, has a generally rectangular cross section as viewed in a horizontal plane.

The compartment 4 serves to receive an internal body or insert 6 which is also molded from synthetic resin material. The body 6, best seen in FIG. 1, is formed with a generally cylindrical configuration and will be described in greater detail below.

The body 1 is provided in the region of the principal compartment 3, with two lateral openings 7 which extend the full height of the compartment 3 and which are disposed diametrically opposite one another and facilitate access of the hand of the user to the glass 5.

A further opening 6 is provided in the body 1 and communicates between the two compartments 3 and 4 over full height H of these compartments.

The insert 6 is a tubular element which is formed with a pair of parallel laterally extending longitudinal lips 9 which define an opening 10 between them. In addition, the tubular insert is provided with a pair of diametrically opposite ribs 11 dimensioned to engage the opposite walls of the compartment 4 as shown in FIG. 1.

The dimensions of the insert 6 are thus such that it is able to be inserted snugly into the compartment 4 and thus to be positioned without play therein. This can be ensured by dimensioning the lips 9 so that they engage snugly between a pair of inwardly turned tapering lips 8*a* which define the opening 8 previously mentioned and form part of the wall separating the two compartments.

A thin ligature 9*a* interconnects the lips 9 to afford stability to the insert 6. Additional ribs 11 may also be provided if required.

When the insert 6 is mounted in the compartment 4, its upper end lies flush with the upper face of the body 1, the insert 6 having the height H equal to the height of the compartment 4. The insert 6 defines within the compartment 4 a cylindrical space or chamber (central chamber) 6*a* into which the tube of dentifrice 12 can be inserted. Since the side 6*b* of the insert 6 diametrically opposite the opening 10 also abuts the wall 4*a* of the compartment 4, the insert 6 defines via the ribs 11 four cylindrical chambers 14, each adapted to receive the handle of a toothbrush 14 as has been illustrated in FIG. 1.

The holder thus makes accessible all of the accessories generally used for dental care, namely a toothbrush 14, a tube of dentifrice and a mouth-rinsing glass 5. Each of these accessories can be readily removed and withdrawn and it can be observed that even if the tube 12 has been made relatively short, e.g. by rolling up its bottom as dentifrice is used, its accessibility is not limited because the user need only insert one of his fingers through one of the openings 7 and the central opening 6 of the body 1, then through the opening 10 of insert 6 to effect withdrawal of the dentifrice-paste tube.

Apart from the advantage of convenience in use as described, the carrier or holder of the present invention has another important advantage, i.e. facility with respect to cleaning or sterilization if desired. The secondary body or insert 6 is readily removable so that the entire unit can be cleaned quickly under the tap of the washbasin. The openings 7, 8, and 10 ensure rapid cleaning of all of the components.

The floor or bottom 3*a* on the compartment 3 is also provided with an orifice 15 permitting water to drain from the inverted glass 5 when it is replaced upon the unit.

Naturally, the device of the present invention is not limited to the embodiment illustrated and described and it can be modified within the limits of the accompanying claims without departing from the principles of the invention. For example, various types and materials can be used to fabricate the structure of the present invention. The body may be molded or shaped by various processes as well without departing from the spirit and scope of the invention claimed.

I claim:

1. A holder for dental accessories, namely a mouth-rinsing receptacle, a tube of dentifrice and at least one toothbrush, comprising a body formed with two parallel upwardly open compartments having a common floor, a first of said compartments being dimensioned to receive said receptacle which can rest upon said floor, the second of said compartments receiving a removable cylindrical tubular insert resting on said floor and having outwardly extending ribs defining in said second compartment a plurality of upwardly open outer chambers adapted to receive the handles of toothbrushes, the interior of said insert defining a central chamber adapted to receive the tube of dentifrice, said compartments communicating between them through a lateral opening in a wall separating said compartments from one another, said insert having a slot-shaped vertical lateral opening registering with the opening in said wall and extending substantially from the top to the bottom of said insert for affording lateral access to said central chamber for withdrawal of said tube of dentifrice.

2. The holder defined in claim 1 wherein said insert and is formed with a pair of diametrically opposite ribs engaging opposite walls of said second compartment to define therewith the chambers receiving the toothbrushes.

3. The holder defined in claim 2 wherein said insert is provided with a pair of lips defining said opening of said insert between them and received between the edges defining said opening in the wall separating the compartments.

4. The holder defined in claim 3, further comprising a ligature connecting said lips at one end of said insert.

5. The holder defined in claim 3 wherein said body is provided with a pair of diametrically opposite windows opening into said first compartment and affording access to said receptacle.

6. The holder defined in claim 5 wherein said first compartment is provided with a floor and said floor is formed with an orifice enabling draining of liquids from an inverted receptacle positioned on said floor.

7. The holder defined in claim 6 wherein said insert has a height corresponding to the height of said second compartment whereby said insert lies flush within upper face of said body.

8. The holder defined in claim 7 wherein said first compartment is of generally horizontal cross section and said second compartment is generally of rectangular horizontal cross section.

* * * * *